United States Patent [19]

Shiurila

[11] 4,353,654

[45] Oct. 12, 1982

[54] DIRECT INK DELIVERY SYSTEM FOR PRINT HEADS UTILIZING ADJUSTABLE MEANS FOR CONTROLLING INK FLOWS

[75] Inventor: John Shiurila, Londonderry, N.H.

[73] Assignee: Centronics Data Computer Corp., Hudson, N.H.

[21] Appl. No.: 150,319

[22] Filed: May 16, 1980

[51] Int. Cl.[3] ..... B41J 27/04; B41J 27/20

[52] U.S. Cl. ..... 400/124; 400/471; 101/93.05

[58] Field of Search ..... 400/124, 470, 471, 471.1, 400/202, 202.1, 202.2; 101/93.05

[56] References Cited

U.S. PATENT DOCUMENTS

| | | | |
|---|---|---|---|
| 414,846 | 11/1889 | Smith | 197/150 |
| 2,530,697 | 11/1950 | Higgins | 197/150 |
| 3,400,801 | 9/1968 | Swenson | 197/171 |
| 4,194,846 | 3/1980 | Zerillo | 400/124 |

FOREIGN PATENT DOCUMENTS 2546835 4/1977 Fed. Rep. of Germany .

OTHER PUBLICATIONS

IBM Technical Disclosure Bulletin, vol. 14, No. 9, (Feb. 1972), p. 285, "Self-Inking Print Wires", by J. E. Lisinski and R. Cross.

IBM Technical Disclosure Bulletin, vol. 14, No. 10, (Mar. 1972), p. 2980, "Print Wire Inking System", by J. E. Lisinski.

*Primary Examiner*—Paul T. Sewell

*Attorney, Agent, or Firm*—Kenway & Jenney

[57] ABSTRACT

An ink delivery system employing capillary member for delivering ink from a container directly to the tips of reciprocating print wires for ink transfer to a print receiving medium. Adjustment is provided for regulating the surface contact area between an ink container capillary member and a print head capillary member to regulate ink flow in order to accommodate printing speed and compensate for any factors which may alter ink flow, whether they be to cause more or less rapid ink flow. In a preferred embodiment, the ink container capillary member is moved relative to the print head capillary member. The capillary members are comprised of a porous material. Adjustment of ink flow is simplified through the provision of an easily movable handle arm and cooperating serrated slot for simply and rapidly adjusting the interface between the cooperating capillary members through which interface the ink is caused to flow.

28 Claims, 9 Drawing Figures

DIRECT INK DELIVERY SYSTEM FOR PRINT HEADS UTILIZING ADJUSTABLE MEANS FOR CONTROLLING INK FLOWS

FIELD OF THE INVENTION

The present invention relates to inking means for use in cooperation with impact printers and more particularly to a novel, direct inking technique for use with impact printers and the like and which incorporates an adjustable ink flow control means of simplified and yet highly effective design.

BACKGROUND OF THE INVENTION

Impact printers, such as for example, dot matrix printers, have conventionally employed inking means in the form of a ribbon saturated with ink and positioned between the print receiving medium and the printing tips of the reciprocating print wires which drive the ribbon against the print receiving medium, causing ink in the region of the ribbon impacted by the print wire tip to be transferred to the print receiving medium, the shape of the area formed on the print receiving medium by the transferred ink substantially conforming to the cross-sectional configuration of the print wire, which is typically circular, thereby forming a dot upon the print receiving medium.

The use of ink ribbons necessitates a mechanism for supporting the ribbon, driving the ribbon and both unreeling and taking up the ribbon. Ribbons are susceptible to breakage and are clumsy and messy to replace. The well-known ribbon systems employing take-up and supply reels have since been replaced to a large degree by cartridge assemblies which are simpler and not quite as messy to remove and replace. However, such cartridge assemblies are expensive and require rather frequent replacement.

The disadvantages of the conventional ink ribbon has led to the development of a direct delivery system described, for example, in copending application Ser. No. 901,182, filed Apr. 28, 1978, now U.S. Pat. No. 4,194,846 issued Mar. 25, 1980, and assigned to the assignee of the present applicaton. The system described therein teaches an ink container for delivering liquid printing material to the sides of the print wires. The ink along the sides is then conveyed to the tips of the print wires which transfer the liquid printing material to a print receiving medium when the tips are impacted against said medium. Although this design totally eliminates the need for an inked ribbon and all of its accompanying disadvantages, it has been found that the apparatus described in the aforementioned U.S. patent lacks means to accurately regulate the amount of ink delivered to the print wires, in that the system described therein has been found to drip and splatter ink, causing smudging of the ink resulting in a noticeable reduction in print quality. The ink has also been found to dry out prematurely. An effort to solve some of these problems has led to the development of the direct inking system described in U.S. application Ser. No. 044,758, filed in the U.S. Patent Office on June 1, 1979, filed by this inventor and assigned to the assignee of the present application. The system described therein teaches a capillary member mounted within the print head and cooperating with a capillary member mounted within the ink container for delivering ink to the print wires a spaced distance inwardly from the forward printing tips and further incorporating sponge-like absorbent elements positioned between the printing tips and the print head capillary members for controlling the flow of ink forwardly from the print head capillary members to the printing tips and further serving as an intermediary ink storage means.

One of the objectives that the present inventor has strived to attain is the design of a universal direct inking system for print heads which is capable of being used in printers having variable printing speed, as well as being capable of being used over a larger range of different printers, each having different printing speeds. For example, it is obvious that a dot matrix printer model capable of printing at twice the speed of another dot matrix printer model requires that ink be capable of being delivered to the printing tips at twice the rate. It has been found that the direct inking system described in the aforementioned U.S. patent, and in pending application Ser. No. 44,758, is incapable of providing an arrangement in which ink flow is capable of accommodating very high speed printers and which may be regulated to accommodate significant differences in printing speed. In addition to the above, it is important to be able to provide relatively fine adjustments in ink control to prevent ink splattering as a result of too great an ink flow rate which may result, for example, due to significant increases in ambient temperature conditions which affect ink viscosity, for example.

BRIEF DESCRIPTION OF THE INVENTION

The present invention is characterized by comprising a direct ink delivery system for use with impact printers and the like and utilizing an ink regulating apparatus and technique which simply and yet accurately provides for positive, precise regulation of the ink delivery flow from the ink container to the printing surfaces to compensate for factors which directly affect print quality, such as print speed, ink viscosity, changes in capillary characteristics of the capillary members due to clogging, drying out, and so forth. The ink delivery system of the present invention comprises a snap-on member for supporting the print head capillary member and which is adapted to readily snap into position upon the nose of the print head to position and support one end of the capillary member so that it directly receives the printing tips of the print wires. The opposite end of the print head capillary member extends downwardly through the snap-on member and extends into an opening within an ink supply container provided with a container capillary member. Spring means supported upon the snap-on member engages one major surface of the downwardly depending portion of the print head capillary member in order to urge the opposite major surface of the print head capillary against the confronting surface of the ink container capillary member. The surface area of the interface between the two cooperating capillary members controls the amount of ink delivered from the container capillary member through the interface to the print head capillary member. The print head capillary member, in one preferred embodiment, is provided with a tapered lower end. The ink container is floatingly mounted upon a resilient member which normally urges the ink container, which is positioned beneath the print head, upwardly toward the print head.

Adjustable container positioning means is removably mounted upon the print head and is comprised of a pair of swingably mounted arms having surfaces which engage the top surface of the ink supply container. The upper ends of the swingably mounted arms cooperate with a notched slot having a plurality of recesses or notches along one edge thereof for receiving and releasably locking a common handle portion bridging across the upper ends of said arms for maintaining said arms at a particular angular orientation to control the relative distance, measured in a vertical direction, between the print head and the ink supply container thereby adjusting the surface area of the interface between the ink supply capillary member and a print head capillary member. By providing the lower end of the print head capillary member with a tapered contour, the relative change in the magnitude of the interface area is significantly increased, even for small changes in the displacement distance between the print head and the ink supply container.

The aforementioned swingable arms and common handle are preferably formed of a single wire-like member being bent to form the swingable arms and common handle portion.

The wire-like member is swingably mounted upon a stirrup-shaped member which is releasably secured to the print head and includes means serving as the pivot points for the wire-like member, as well as the notched arcuate member.

The snap-on member which supports the print head capillary member is designed to be easily and readily snapped on and off of the print head to greatly facilitate replacement of the capillary member, for example. The support for the ink supply container, in addition to resiliently supporting the ink supply container, provides an arrangement which is adapted to permit simple, rapid removal and replacement of the ink supply container.

The ink supply container is designed to minimize sloshing, splashing and splattering of its contents and further provides a sleeve for removably supporting the ink supply container capillary member to facilitate its removal and replacement and to facilitate the mating engagement between the cooperating capillary members.

OBJECTS OF THE INVENTION AND BRIEF DESCRIPTION OF THE FIGURES

One object of the present invention is to provide a novel, direct delivery system for supplying ink directly to the printing surfaces of the print members in an impact printer.

Another object of the present invention is to provide a delivery system for impact printers and the like having novel flow control means.

Still another object of the present invention is to provide an ink delivery system for print heads and the like incorporating novel flow control means comprising relatively movable capillary members.

Still another object of the present invention is to provide a direct ink delivery system for printers and the like comprising a pair of capillary members and means for moving said capillary members relative to one another for regulating ink flow.

Still another object of the present invention is to provide a novel, direct ink delivery system for print heads and the like comprising a pair of capillary members having engaging surfaces through which ink is delivered from an ink supply container to the printing tips of the print head and for moving said capillary members relative to one another for altering the surface area of the engaging surfaces and thereby regulating the flow of ink thereacross.

Still another object of the present invention is to provide an ink container for supporting a capillary member and which is designed to prevent ink from splashing, splattering and undue sloshing when in use on a printer.

The above, as well as other objects of the present invention, will become apparent when reading the accompanying description and drawings in which:

FIG. 1 is an exploded perspective view of a novel direct inking system and employing a flow control apparatus which system embodies the principles of the present invention.

FIGS. 2*a*, 2*b* and 2*c* are top plan, left-hand side elevational and rear elevational views respectively of the snap-on nose member of FIG. 1;

Figure 1:
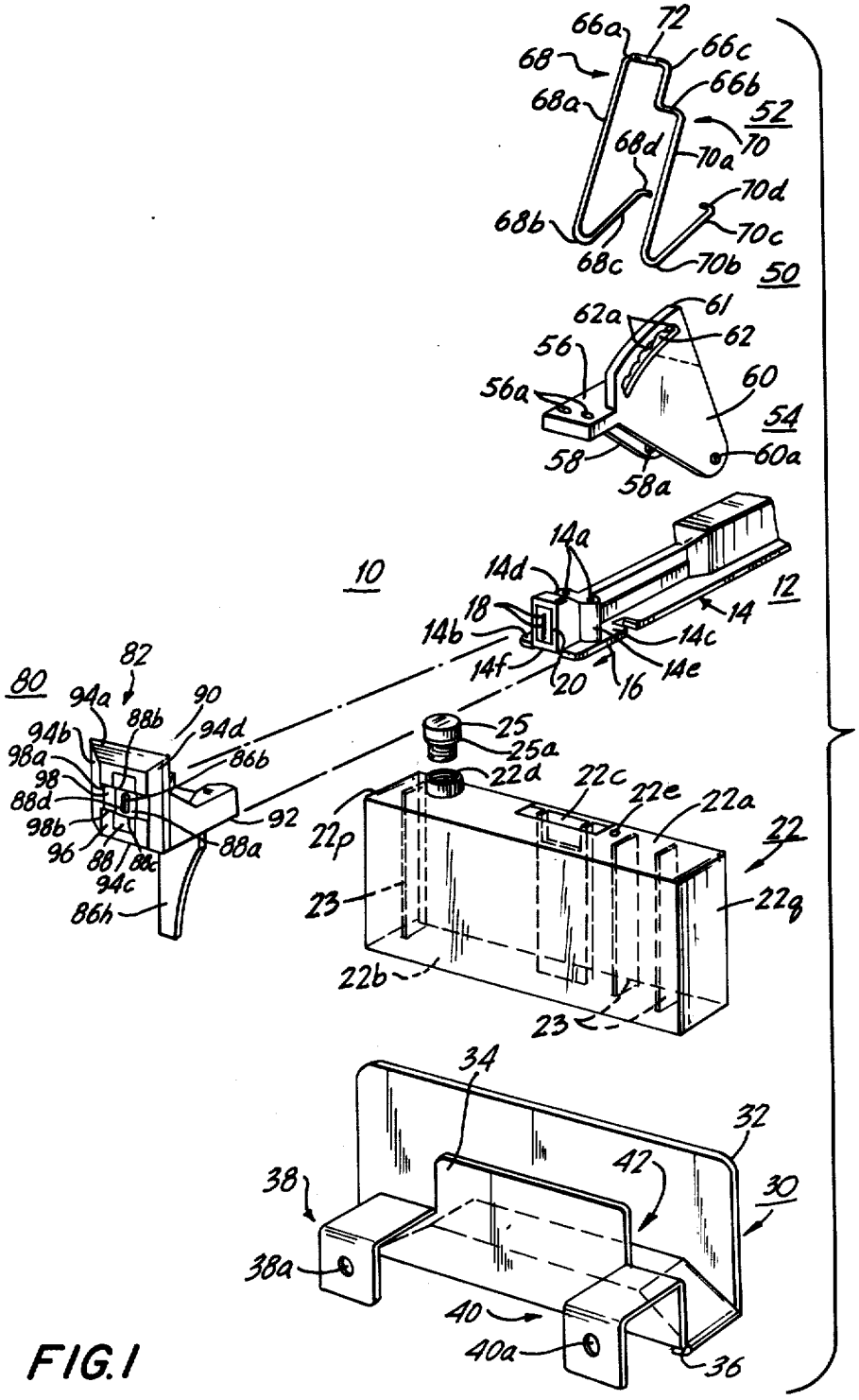
Figure 4:
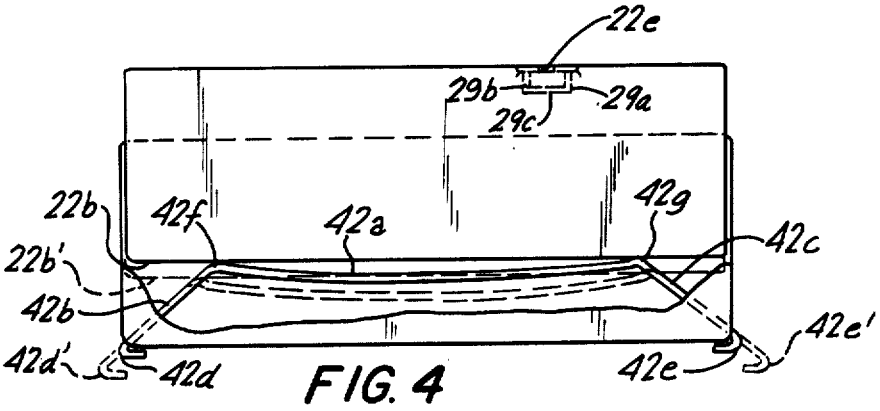
FIG. 4 is a detailed elevational view of the ink supply container and supporting bracket therefor.
Figure 4A:
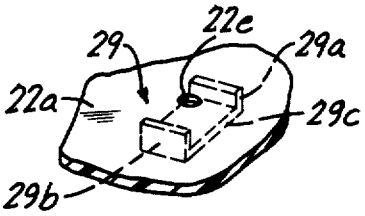
Figure 4B:
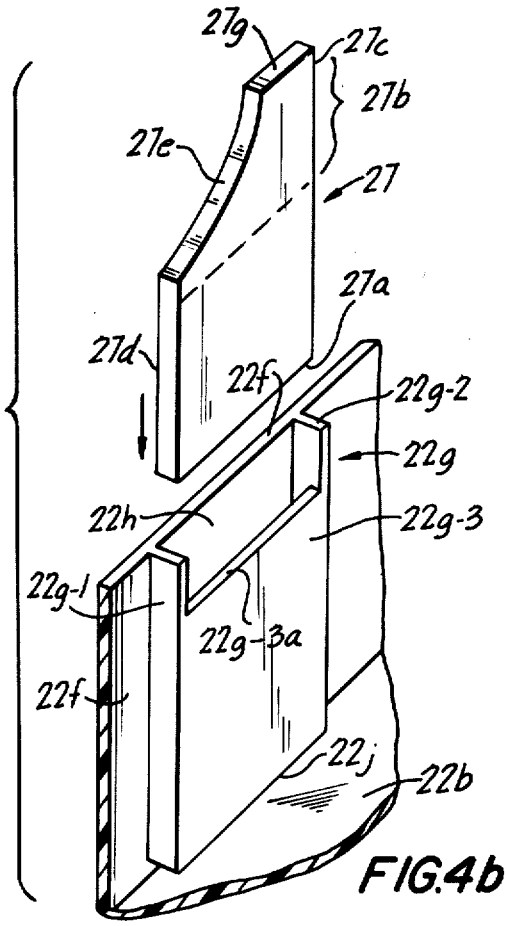

FIG. 4*a* is an exploded perspective view of a splash deflector employed in the container of FIG. 1;

FIG. 4*b* is a perspective view of a portion of the interior of the ink container of FIG. 1 showing a sleeve for supporting a capillary member.

Figure 5:
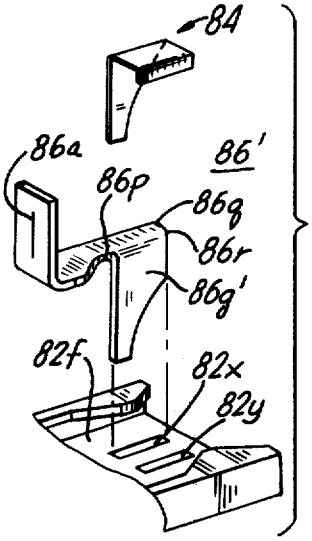

FIG. 5 is an exploded perspective view of a modified print head capillary member and cooperating support spring and modified bracket therefor.

BEST MODE FOR CARRYING OUT THE INVENTION

FIG. 1 is an exploded perspective view showing a preferred embodiment 10 of the present invention, and which is employed with a print head 12 of the dot matrix impact type and preferably of the type described in U.S. Pat. No. 4,165,940, issued Aug. 28, 1979, and assigned to the assignee of the present invention. The print head, 12, typically referred to as a print head of the free-flight type, is comprised of a plurality of electromagnets (not shown) arranged to selectively urge their associated print wires (not shown), arranged within a nose cone member 14 to be moved rapidly in the forward or printing direction, as shown by arrow 16, in order to impact against the print receiving medium (not shown) which may, for example, be a continuous elongated paper web WB (see FIG. 3 ) of indeterminate length, said paper web WB being supported by a platen P, which, for example, may be adapted to rotate in the clockwise direction as shown by arrow 16 to advance the paper web WB in order to perform a "line feed" operation. Obviously, the platen P may be adapted to rotate in the reverse direction, either for removal of the paper web WB, for reprinting on an already printed line, or for any other purpose.

The print head assembly 12 is preferably mounted upon a carriage (not shown) which is slidably guided by suitable guide members (not shown) mounted to move the print head 14 along a linear path so as to be capable of moving back and forth across the platen P, as is conventional in such printers. The rear ends of the print wires W cooperate with armature members (not shown) forming part of the electromagnets and extend forwardly through the nose cone member 14 of the print head where all of the print wires W merge so that their front tips, which are aligned along an imaginary vertical line, extend through the forward end of nose cone 14 and are maintained in the aforesaid linear vertical alignment by means of a bearing member 20, which may, for example, be a jewel bearing such as a ruby or sapphire member having a plurality of openings 18 each being adapted to receive and align one of the reciprocating print wires W.

In contrast to conventional printers, the need for an inked ribbon in the system 10 of FIG. 1 is eliminated and is replaced by the direct ink delivery system of the present invention which is comprised of an ink container 22 releasably resiliently mounted upon container support assembly 30. Although container 22 is shown to be of a regular shape, such as for example a rectangular, parallelepiped, the container 22 may also have an irregular shape in order to take maximum advantage of the geometry of the immediate surroundings in order to be able to store the maximum amount of ink.

The container mounting assembly 30 is shown as being comprised of a substantially U-shaped bracket having upwardly extending substantially parallel arms 32 and 34 joined along their lower ends to a yoke portion 36. A pair of mounting arms 38 and 40 are bent outwardly and then downwardly from arm 34 and are each provided with openings 38*a* and 40*a* for receiving fastening members to secure a bracket to the carriage (not shown) upon which the print head, i.e. the nose cone 14, is mounted for reciprocating movement across the platen P of the printer, as is conventional.

A flexible leaf spring 42 is positioned between arms 32 and 34 of the container mounting bracket and is provided with the central, slightly concave, portion 42*a* shown best in FIG. 4 as having a pair of arms 42*b* and 42*c* integral with central portion 42*a* and bent downwardly and outwardly so as to be diagonally aligned. The free ends of arms 42*b* and 42*c* are bent inwardly at 42*d* and 42*e* respectively, so as to embrace the opposing edges of yoke portion 36 when the ink container 22 is removed from the supporting bracket 30.

The container 22 is preferably formed of an inexpensive disposable plastic material capable of being molded, for example, although any other fabrication process may be employed. The plastic material and the thickness of same is chosen to withstand fracturing which may be experienced during normal handling and to withstand chemical erosion due to the erosive characteristics of the constituents within the liquid printing material.

Since the container 22 moves with the print head 12 during printing, to prevent ink from sloshing around unnecessarily, baffles 23 are provided in the container 22 and are integrally joined to the interior of top wall 22*a* and extend downwardly toward bottom 22*b* but are arranged a spaced distance above bottom 22*b*. A rectangular shaped slot 22*c* is provided in top 22*a* for exposing the ink supply container capillary member 27 as well as providing adequate entry space for inserting the print head capillary member 86, as will be more fully described hereinbelow. In order to permit container 22 to be refilled, an opening or neck 22*d* is provided in top portion 22*a* for receiving a threaded fastening member 25, having a gasket 25*a* for adequately liquid-tightly and air tightly sealing the opening 22*d*. Member 25 may cooperate with tapped opening 22*d* to form an air relief opening, by turning threaded member 25 about a quarter-turn to one-half turn to loosen the air-tight seal and thereby permit air to enter into the interior of container 22 as ink is dispensed. Alternatively, a small air hole 22*e* may be provided in top portion 22*a*. Considering FIGS. 4 and 4*a*, which show air hole 22*e*, in order to prevent the ink (not shown) from splashing out through air relief hole 22*e*, while permitting the relatively free flow of air into the interior of container 22 through air relief hole 22*e*, container 22 is provided with a splash deflector 29 having a substantially U-shaped form comprised of vertically aligned arms 29*a* and 29*b* joined to a horizontally-aligned yoke portion 29*c*, which is arranged a small spaced distance beneath air relief opening 22*e*, the ink deflector 29 serving to prevent ink from splattering out of the container 22 while allowing air to freely enter into the container through opening 22*e*. When using the combination of tapped opening 22*d* and threaded member 25 as the air relief means, a similar deflection plate may be positioned beneath opening 22*d*.

The bottom surface 22*b* of container 22 is adapted to rest upon two points 42*f* and 42*g* of resilient spring 42*a* positioned between the bracket assembly 30. The free ends of spring 42 has inwardly bent ends 42*d* and 42*e* which embrace the opposite edges of the central portion 36 of bracket assembly 30 when an ink container 22 is removed. If the ink container 22 is pressed downwardly, the arm portions 42*b* and 42*c* flex and the inwardly bent ends 42*d* and 42*e* move, for example, to the dotted line positions 42*d*' and 42*e*'. As can be seen, the spring member 42 normally urges container 22 in the upper vertical direction. The container, as can best be seen from exploded FIG. 1, is positioned beneath the nose cone portion of the print head assembly 12.

FIG. 4*b* shows an exploded view of the ink supply container capillary member 27 and cooperating sleeve 22*g* provided within the container 22 to receive the capillary member 27 and wherein a major portion of the container 22 has been cut away to facilitate an explanation of the ink supply container sleeve 22*g* and ink supply container capillary member 27 which it receives. In one preferred embodiment, the side wall 22*f* of the container is provided with a sleeve 22*g*, integrally joined to the interior of sidewall 22*f* so as to form a hollow, rectangular space 22*h* for receiving the ink supply container capillary member 27. The sleeve 22*g* which defines the opening 22*h* which receives capillary member 27 is defined by sidewall 22*f*, outwardly extending arms 22*g*-1 and 22*g*-2 and wall 22*g*-3 which is arranged in spaced parallel fashion with sidewall 22*f* and which is integrally joined to arms 22*g*-1 and 22*g*-2. The lower end 22*j* of sleeve 22*g* is arranged a spaced distance above the floor 22*b* of container 22 so as to expose the bottom portion of the capillary member 27 which is normally inserted into opening 22*h* so that its bottom edge 27*a* rests upon floor 22*b*. Wall 22*g*-3 has a cutaway portion 22*g*-3*a* to expose the upper portion of capillary member 27 represented by bracket 27*b* to facilitate engagement between capillary members 27 and 86, as will be more fully described. Capillary member 27 is shown as having one straight vertical edge 27*c* and a second straight end 27*d* which bends over a portion of the overall length and which is notched or tapered at 27*e* in a manner similar to the print head capillary member to be more fully described. As will be explained hereinbelow, the notched-away portion 22*g*-3*a* of the sleeve 22*g* exposes portion 27*b* of capillary member 27 to permit the print head capillary member 27 to make surface contact therewith. Capillary member 27 may have two curved or sloping sides, if desired.

Turning to a consideration of FIGS. 1 and 2*a* through 2*c*, there is shown therein a capillary member support assembly 80 comprising a snap-on member 82, which serves as a means for supporting the print head capillary member 86 and antismudge shield 88, as will be more fully described hereinbelow. Assembly 80 is comprised of a unitary one-piece member 82, a biasing spring 84, a print head capillary member 86 and an anti-smudge shield 88.

Figure 2A:
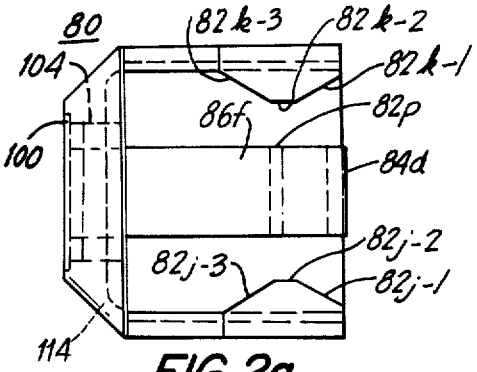
Figure 2C:
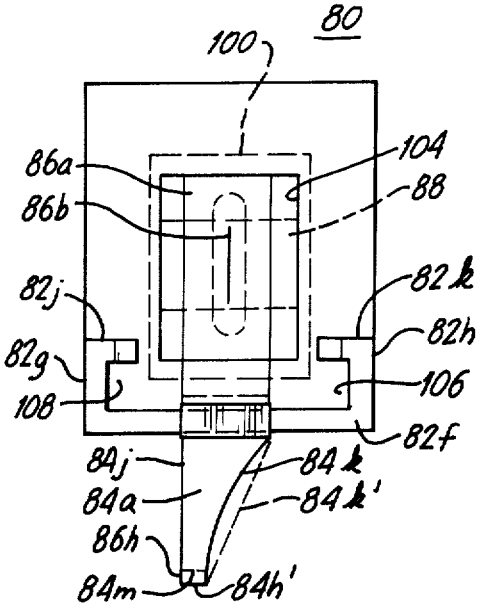
Figure 2B:
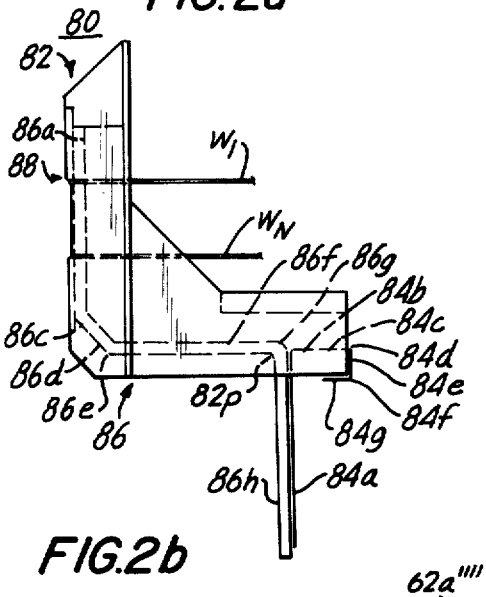

One-piece member 82 is preferably formed of a suitable plastic material and is comprised of a substantially vertically aligned forward portion 90 and a substantially horizontally aligned base portion 92. Portion 90 is provided with four bevelled sides, 94*a* through 94*d*, which form a bevelled frame about the front surface 96 which is substantially flat except for a recess 98 extending across the entire width of front portion 90 and defined by an upper edge 98*a* and a lower edge 98*b*. A shallow rectangular-shaped recess 100 is provided in the front surface 96 which, as can best be seen in FIG. 2*c*, is defined by the dotted rectangle 100 shown in the rear elevational view of FIG. 2*c*. The depth of the recess 100 is sufficient to receive metal shield 88 and a suitable cement, epoxy or other adhesive member, so that the front surface of metal shield 88 is flush with the front surface 96 of member 82. A shallow recess 88*a* is machined into the front surface of metal shield 88 and is defined by its upper and lower edges 88*b* and 88*c* respectively, which edges coincide with the edges 98*a* and 98*b* defining recess 98 in front surface 96. The recessed surface 88*a* of shield 88 is substantially flush with the recessed surface 98. These two recesses 88*a* and 98*a* cooperate to prevent smudging of the ink transferred to the paper web from the printing tips of the print wires by surfaces 98 and 88*a*.

The forward portion of member 82 is provided with a rectangular-shaped through-opening 104 represented by the solid rectangle 104 shown best in FIG. 2*c*. The through-opening 104 can be seen to have a width which is greater than the width of the capillary member 86, portion 86*a* of the capillary member being seen in the rear elevational view of FIG. 2*c*. Surrounding the through-opening 104 is the rectangular shaped recess 100 shown in dotted line fashion in FIG. 2*c*. As was described hereinabove, metal shield 88 fits into recess 100 and has a height and width substantially equal to the height and width of recess 100. Still considering the rear elevational view of FIG. 2*c*, the base portion of the snap-on nose member 82 is comprised of a bottom or floor portion 82*f*, having a pair of upwardly extending flexible, resilient arms 82*g* and 82*h*. The upper ends of arms 82*g* and 82*h* are bent inwardly, forming the inwardly directed flanges 82*j* and 82*k* respectively. Turning to a consideration of FIG. 2*a*, the arms 82*g*, 82*h* can be seen to have first diagonally aligned portions 82*j*-1 and 82*k*-1, flat portions 82*j*-2 and 82*k*-2, and curved portions 82*j*-3 and 82*k*-3 which are curved concave surfaces which cooperate with an associated curved projection forming part of nose cone 14, as will be more fully described hereinbelow.

As can best be seen from FIG. 2*c*, the inwardly directed flanges 82*j* and 82*k* cooperate with the floor 82*f* to form a pair of slots for receiving outwardly extending flanges 14*b* and 14*c*, forming an integral part of nose cone 14, shown in FIG. 1. The manner in which the snap-on member 82 is mounted to nose cone 14 is as follows:

The forward end of nose cone 14 is positioned so that its flanges 14*b* and 14*c* are aligned with slots 106 and 108. The nose cone is then pushed into the snap-on member 82, in the direction of arrow 114, so that flanges 14*b* and 14*c* enter into slots 106 and 108. In doing so, the semi-circular shaped projections 14*d* and 14*e* forming an integral part of nose cone 14, make sliding engagement with diagonal surfaces 82*j*-1 and 82*k*-1, which define a V-shape, causing the flanges 82*j* and 82*k* and the upright portions 82*g* and 82*h* to flex outwardly, due to the forces exerted on these flanges by the curved projections 14*d* and 14*e*. Maximum flexing occurs as the curved portions 14*d* and 14*e* slidably engage the flat portions 82*j*-2 and 82*k*-2 which are substantially parallel to one another. As the nose cone 14 is moved still further in the direction of arrow 114 shown in FIG. 2*a*, the semi-circular shaped projections 14*d* and 14*e* engage the concave surfaces 82*j*-3 and 82*k*-3, whereupon the flexed members 82*g* and 82*h* and 82*j* and 82*k* are free to move rapidly toward one another, causing the forward end of the nose cone 14 to be rapidly urged forward and snapped into place within member 82. The combination of the resilient flexible flanges 82*g*, 82*h* and the curved concave surfaces 82*j*-3 and 82*k*-3 serve to retain the snap-on member in position relative to the nose cone 14, whereby the forward edge 14*f* of nose cone 14 rests against the recess designated by dotted line provided in member 82, shown best in FIG. 2*a*.

The metal shield 88, which is formed of a thin gauge non-corrosive metal, preferably stainless steel or copper for example, is provided with an elongated oval-shaped slot 88*d* which surrounds a slit 86*b* provided in the upper portion 86*a* of the capillary member 86 provided in assembly 80. The slit 86*b* is adapted to receive the tips of the print wires Wl through Wn, shown best in FIG. 2*b*. The print wires W extend through the openings 18 in jewel 20 and, when the electromagnets (not shown) for the print wires are at rest, the tips extend a predetermined distance beyond the front surface of jewel 20 and are embedded in the body portion 86*a* and within slit 86*b*. When the electromagnets (not shown) are energized, the print wires W move in the direction shown by arrow 114 in FIG. 2*a*, and move to a position beyond the front surface of shield 88 to impact the paper web which is supported by a suitable platen, as is conventional in printers of this type.

The capillary member 86 has a bend at 86*c* to provide a diagonally aligned straight short portion 86*d*. The capillary member 86 bends again at 86*e*, forming a straight horizontal portion 86*f*, and bends again at 86*g* forming a straight vertically aligned portion 86*h*, at least a portion of which is adapted to extend into the opening 22*c* in ink supply container 22 (see FIG. 1) and to engage a portion of the ink supply capillary member 27, as will be more fully described.

The vertically aligned portion 86*h* of capillary member 86 extends downwardly through a slot 82*p* in the base of member 82. Also extending through slot 82*p* is a resilient leaf spring 84 having a downwardly depending portion 84*a* which is bent at 84*b* to form a horizontally aligned portion 84*c*; which is bent again at 84*d* to form a vertically aligned downwardly extending portion 84*e* and which is bent at 84*f* to form a horizontally aligned, short, free end portion 84*g*. The upper part of portion 84*a* and portions 84*c*, 84*e* and 84*g* cooperatively embrace the rear of the base portion 92 of member 82 to secure spring 84 to member 82. Portion 84*a* of the spring member, as can best be seen in FIG. 2*c*, has a straight, vertically aligned, left-hand side 84*j* and a curved righ-hand side 84*k*, the spring member tapering downwardly to a flat bottom portion 84*m*. As an alternative, the tapered side 84*k* may be a diagonally aligned straight edge 84*k*'. The lower portion 86*h* of capillary member 86 preferably has the same shape as the lower portion 84*a* of spring member 84, so that its left-hand side is straight and coincident with side 84*j*, or so that its right-hand side is either curved and coincident with side 84*k*, or a diagonal straight line and coincident with side 84*k*.

If desired, both sides of the spring may be diagonal straight lines such as side 84*k'*. Also, both sides may be curved as shown by curved side 84*k*.

When the snap-on assembly 80 is mounted upon the nose cone 14 in the manner described hereinabove, the ink container assembly 22 may thereafter be positioned upon bracket assembly 30 by pressing the ink container assembly downwardly upon spring 42, so that the top surface 22*a* of the container clears the bottom edge 84*h'* of the portion 86*h* of capillary member 86, which can best be seen in FIG. 2*c*, is slightly greater in length than spring portion 84*a*.

When slot 22*c* is positioned immediately beneath the cooperating portion 86*h* of capillary member 86 and portion 84*a* of spring 84, the container assembly 22 may be released, allowing spring 42 to urge the container 22 upwardly, whereupon the portion 86*h* of capillary member 86 and the spring portion 84*a* of spring 84 enter into slot 22*c*. As shown best in FIG. 4*b*, the cutaway portion 22*g*-3*a* exposes the upper portion 27*b* of the ink supply container capillary member 27, allowing the left-hand major surface of the bottom portion 86*h* of capillary member 86 to make surface contact with the right-hand major surface of the upper portion 27*b* of ink supply capillary member 27 shown in FIG. 4*b*. Spring 84 urges portion 86*h* of capillary member 86 towards capillary member 27.

Figure 3:
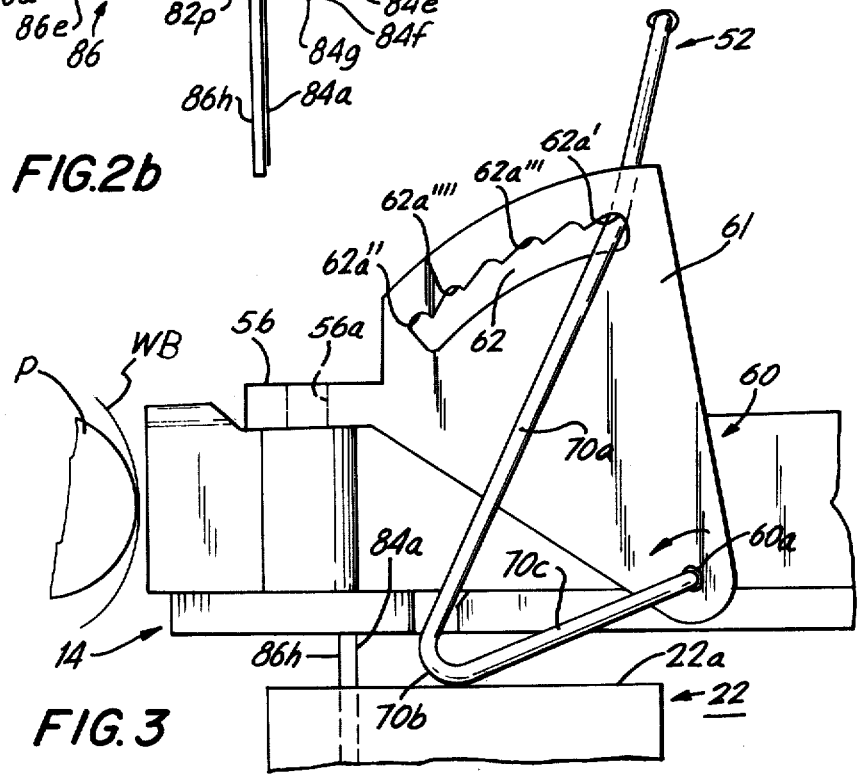
FIG. 3 is a side elevational view of the stirrup member and cooperating handle assembly shown in FIG. 1.

The position of ink container 22 is adjusted by the cooperating stirrup-shaped member 54 and handle assembly 52 shown best in FIGS. 1 and 3. Handle assembly 52 is preferably formed of a resilient metallic wire bent into a configuration comprised of a pair of substantially V-shaped portions 68 and 70, each comprised of arms 68*a*, 68*c* and 70*a*–70*c*, joined at curved knee portions 68*b* and 70*b*, respectively. The free ends of arms 68*c* and 70*c* are bent inwardly, forming pivots 68*d* and 70*d*. The upper ends of arms 68*a* and 70*a* are integrally joined to a substantially Z-shaped handle portion comprising a gripping section 66*a*, a notch-receiving section 66*b* and an intermediate section 66*c* integrally joined to sections 66*a* and 66*b*.

The stirrup-shaped member 54, which has an h-shaped configuration, comprises a rigid plastic member having a central portion 56 and a pair of downwardly depending arms 58 and 60 and an upwardly directed projection 61 having an elongated arcuate-shaped slot 62 provided with a plurality of notches 62*a* along the upper edge of slot 62.

The lower ends of arms 58 and 60 are provided with openings 58*a* and 60*a* and central portion 56 is provided with openings 56*a*.

Member 52 is positioned upon nose cone 14 so that arms 58 and 60 straddle nose cone 14. Openings 56*a*, which are clearance openings, are positioned above openings 14*a* in semi-circular shaped projections 14*d* and 14*e* and receive self-tapping screws (not shown) which threadedly engage nose cone 14 to secure stirrup-shaped member 54.

The pivot ends 68*d* and 70*d* of handle assembly 52 are inserted into openings 58*a* and 60*a*, respectively, to swingably mount handle assembly 52 to stirrup-shaped member 54 and hence to nose cone 14. The section 66*b* extends through arcuate-shaped slot 62 while handle section 66*a* extends above slot 62 and the tops of projection 61. The natural resilience of handle assembly 52 normally urges sections 66*a*–66*c* upwardly, urging section 66*b* into one of the notches 62*a*.

To swingably move handle assembly 52, section 66*a* is gripped and pressed downwardly to remove section 66*b* from one of the notches 62*a*. When section 66*b* is cleared of the notches, the handle assembly may be swung either clockwise or counter-clockwise to the desired angular position. The knees 68*b* and 70*b* rest upon the top surface 22*a* of ink supply container 22 and cooperate with spring 42 to determine the position of ink supply container 22 and hence capillary member 27, relative to capillary member 86.

By lifting or lowering container assembly 22 under control of the handle portion 52 in the manner described hereinbelow, the knees 68*b* and 70*b* of the handle member press downwardly upon the top surface 22*a* of container assembly 22 to accurately and yet simply control the vertical position of the ink supply container 22 relative to the print head 12 and hence relative to the portion 86*h* of the print head capillary member 86. In one preferred embodiment, movement of the handle assembly 52 from each notch 62*a* to the next notch causes the knees 68*b* and 70*b* of the handle member to move the ink supply container 22 downwardly over a linear distance of the order of 0.030 to 0.040 inches. This is approximately the linear distance moved by the container assembly 22 due to movement of the handle assembly from one notch 62*a* to the other. For example, when the handle assembly 52 is locked within notch 62*a'*, (see FIG. 3), the ink container assembly 22 occupies its uppermost vertical position. By swinging the handle assembly 52 to the left, i.e., by swinging the handle assembly 52 counterclockwise about the pivot openings 60*a* and 58*a* (see FIGS. 1 and 3), the knees 70*b* and 68*b* move generally downwardly to urge the container assembly 22 downwardly. Thus, in moving the handle assembly 52 from the uppermost notch 62*a'* to the lowermost notch 62*a''*, for example, the container assembly 22 is moved over a total distance in the range from 0.15 to 0.2 inches. Of course, the arcuate slot 62 may be enlarged and a greater or lesser number of notches 62*a* may be provided to provide still further adjustments.

The provision of capillary members 27 and 86 having tapered inter-engaging portions provides a significant change increase in inter-engaging surface area as between the overlapping portions of member 27 and 86 for a relatively small increment of linear movement of the handle assembly 52. This design allows the flow of ink to be controlled since the rate of flow of ink from capillary member 27 through the inter-engaging area to capillary member 86 is a direct function of the size of the interengaging surface area. Thus, the design of the present invention provides a universal assembly usable with printers whose printing rates vary by a significant amount. Thus, a single design direct inking control system may be usable with printers whose printing speeds vary quite remarkably due to the novel ink flow means of the present invention which is able to simply and readily control ink flow.

As one example, let it be assumed that the handle assembly 52 is in its uppermost position as shown best in FIG. 3. In this position, the overlapping inter-engaging area as between the capillary members 27 and 86 is at a minimum. The flow of ink from container 22 through capillary members 27 and 86 to the print wires may be adequate for a printer printing, for example, at 100 characters per second. Let it be assumed that the same print head assembly is now mounted within a printer capable of printing at the speed of 200 characters per second. Given the previous flow rate, insufficient ink will be delivered to the print wire tips causing printing to be quite faint. This may be simply and readily compensated for by positioning bridging portion 78 of handle assembly 52 shown in FIGS. 1 and 3 within notch 62*a*''', for example. In the example of a printer which is capable of printing at four times the speed of the very first mentioned printer, let us assume 400 characters per second, the bridging portion 70*e* of handle assembly 52 may be moved to notch 62*a*''''. Thus, the design of the present invention provides a direct inking system of a universal design which is usable with printers having printing speeds varying over a very wide range.

In addition to accommodating differences in printing speed, fine adjustments may also be made to accommodate ambient conditions which may otherwise alter or degrade the print quality. For example, as the ambient temperature increases, this may significantly reduce the viscosity of the ink, causing the ink to flow more rapidly and possibly cause smearing and smudging. By appropriate adjustment of the handle assembly 52, the flow rate may be reduced to correct for this matter. As another possible condition, due to the passage of time, one or both capillary members 27, 86 may become clogged or otherwise suffer a reduction in their normal capillary flow characteristic, causing the flow rate through the material to be reduced. By appropriate adjustment of handle assembly 52, these changing conditions may be compensated for in order to ensure the desired print quality.

As still a further example, the user may for some particular purpose, desire to print faint characters. This may be readily done simply by appropriate angular positioning of the handle assembly 52. The darkness of the characters may be increased by another appropriate adjustment of the handle assembly 52.

The direct inking technique wherein ink is delivered from the ink supply container directly to the front of the jewel 20 and on to the printing tips and having the printing tips arranged so that they are substantially always embedded within the slit 86*b* provided in the print head capillary member 86, has been found to provide a remarkable increase in ink delivery to the print head 12 and experimentation has shown that there appears to be no upper limit to the printing speed imposed by the direct inking system described herein which has yet to be reached when using the direct inking system of the present invention with a printer having print wires which return to the start position after transferring ink to the print receiving medium.

A latitude of modification, change and substitution is intended in the foregoing disclosure and, in some instances, some features of the invention will be employed without a corresponding use of other features. Accordingly, it is appropriate that the appended claims be construed broadly in a manner consistent with the spirit and scope of the invention herein.

For example, the capillary member 27 in container 22 (FIG. 1) may be provided with a sloping upper edge 27*g*, the spring 42 may be positioned against a vertical sidewall 22*p* of container 22 and a rotatable eccentric cam (not shown) may be positioned against the opposite vertical sidewall 22*q* of container 22 to move the container 22 horizontally to regulate the size of the overlapping surface areas of capillary members 27 and 86.

As another alternative, the engaging surfaces of capillary members 27 and 86 may lie in a plane aligned with the longitudinal axis of the nose cone 14 to allow the nose cone 14 to move along its longitudinal axis to accommodate print receiving media of different plies and different thicknesses. As shown in FIG. 5, capillary member 86' is provided with a slot 86*p*. The rearward portion 86*q* is bent at 86*r* to form downwardly depending portion 86*g*'. The capillary member 27 in container 22 (FIG. 4) may be mounted along a sidewall perpendicular to sidewall 22*f* or bracket assembly 30 may be rotated one-quarter turn (90°) to orient capillary member 27 to be aligned substantially parallel with portion 86*g*' of capillary member 86'.

Portion 86*g*' extends through slot 82*x* in base 82*f* of bracket 82, slot 82*x* replacing slot 82*p*. Spring 84 extends through slots 82*x* and 82*y* so that its portion 84*a* rests against portion 86*g*' of capillary member 86', allowing nose cone 14 to be moved along its longitudinal axis to accommodate forms of different thicknesses while maintaining the capillary member 27 and 86' in surface engagement.

The capillary members 27 and 86 may have shapes other than flat sheets, and may be cylindrical, polygonal, etc. Preferably at least a part of the engaging surfaces of capillary members 86 and 27 should be flat to provide good transfer of ink across the engaging surfaces. For example, the capillary member 27 may be round and have the top portion thereof machined to have a flat surface for engaging capillary member 86. Also a small capillary member may be pierced into the top of the ink container capillary member to be engaged by the print head capillary member.

The capillary members may be formed of any material exhibiting good capillary action, such as loosely (or tightly) compressed cellulose, natural fibers, or plastic. The capillary member 27 may be covered with a liquid-proof cover over its entire length except for the upper portion where it engages capillary member 86 and the lower portion where it is immersed in the ink, in order to assure uniform delivery of ink from member 27 to member 86, even during sloshing of the ink.

What is claimed is:

1. Apparatus for direct delivery of ink to a printing member comprising:

a reciprocating member having a printing face at its forward end; an ink supply container;

a first capillary member in said container, at least a portion thereof being immersed in the ink in said container;

a bracket for supporting a second capillary member so that at least a first portion of said second capillary member is positioned to wipingly engage said printing member and a second portion thereof extends into said container and engages said first capillary member;

means for moving said first and second capillary members relative to one another for altering the flow of ink therebetween.

2. The apparatus of claim 1 wherein the second portion of said second capillary member is provided with a tapered end which engages a portion of said second capillary member.

3. The apparatus of claim 1 wherein said second capillary member has a tapered portion engaging the first end of said first capillary member.

4. The apparatus of claim 1 wherein said first capillary member is comprised of a porous sheet adapted to convey ink from the portion of said first capillary member immersed in the ink to said second portion by capillary action.

5. The apparatus of claim 1 wherein said second capillary member is comprised of a porous sheet adapted to convey ink from said ink container to said first capillary member by capillary action.

6. The apparatus of claim 1 wherein said means for moving capillary members relative to one another comprises:

means for resiliently mounting said ink supply container;

swingably mounted handle means;

support means for pivotably supporting said handle means;

said handle means having a portion engaging said ink supply container for urging said container away from said first capillary member when said handle means is pivoted in a first direction and for enabling said ink supply container to be moved towards said first capillary member by said resilient mounting means when said handle means is pivoted in a second direction.

7. The apparatus of claim 6, wherein said handle means portion engaging said ink supply container further comprises a pair of substantially V-shaped sections having a pair of arms joined at a knee portion, the free ends of one of said arms being pivotally mounted to said support means;

a handle portion joining the free ends of the remaining arms of said V-shaped sections.

8. The apparatus of claim 7 further comprising releasable means for selectively locking said handle means at any one of a plurality of angular positions to retain said ink supply container at a position determined by the angular orientation of said handle means.

9. The apparatus of claim 8 wherein said releasable means comprises an arcuate slot having a plurality of notches;

said handle portion extending through said slot and being selectively positionable in any one of said notches.

10. The apparatus of claim 9 wherein said handle means is formed of a resilient material to enable said handle means to be flexed sufficiently to displace said handle portion from said notches.

11. The apparatus of claim 10 wherein the width of the arcuate slot is sufficient to enable said handle portion to be displaced from said notches to pivot said handle means.

12. The apparatus of claim 1 further comprising a housing for slidably mounting said printing member;

the front of said housing having a bearing for supporting said printing member;

said printing member comprising an elongated slender print wire;

a swingable handle assembly for displacing said capillary members relative to one another;

a handle mounting assembly for pivotally mounting said swingable handle assembly being arranged on said housing;

said swingable handle assembly having a pair of substantially V-shaped portions comprised of a pair of arms integrally joined to one another at a first end, forming a knee portion, the free end of one arm of said pair of arms of each V-shaped portion being pivotally supported by said handle mounting assembly; and said swingable handle assembly further including a handle portion integrally joined to the free ends of the remaining arms of said V-shaped portions to facilitate swingable movement of said swingable handle assembly.

13. The apparatus of claim 12 wherein said handle mounting assembly is a substantially h-shaped member comprised of a central portion and a pair of downwardly depending arms and an upwardly extending projection joined to said central portion; said mounting member being mounted upon said housing, with said pair of arms straddling said housing and said central portion engaging at least a portion of the top surface of said housing.

14. The apparatus of claim 13 wherein said upwardly extending projection is provided with an elongated arcuate slot, said slot having a plurality of notches along one edge thereof;

said handle portion extending through said slot and being adapted to be seated and thereby retained in one of said notches.

15. The apparatus of claim 14 wherein said handle assembly is a wire formed of a resilient material bent into the above defined shape of the handle assembly whereby the resilience of said material normally urges said handle portion towards said notches.

16. The apparatus of claim 13, wherein said pair of projections are each provided with openings at their lower ends for receiving the free ends of said one of said arms of said pair of V-shaped portions for swingably mounting said handle assembly.

17. An ink supply container adapted to be mounted upon a reciprocating carriage for use in supplying ink to a printing member, said container being a hollow plastic housing having a floor portion, a top portion and a sidewall portion integrally joined to said floor and top portions;

a sleeve integrally joined to the interior of said housing along said sidewall portion;

a capillary member positioned in said sleeve; the lower end of said capillary member resting on said floor portion, the lower portion of said sleeve being a spaced distance above said floor portion to enable the lower end of said capillary member to be immersed in the ink in said container;

a plurality of baffles being integrally joined to the interior surface of said container and extending into the pool of ink stored in said housing for attenuating sloshing and splashing of said ink due to reciprocating movement of the housing during printing, said baffles each being thin elongated members having a width many times greater than its thickness forming opposed major surfaces arranged transverse to the direction of reciprocating movement of said container.

18. The container of claim 17 wherein said baffles are joined to the interior of said top portion and extend towards said floor portion, the lower ends of said baffles being displaced from the floor portion.

19. The container of claim 17 further including an opening in said top portion aligned with said sleeve for receiving a second capillary member which extends into said opening and engages at least a portion of the capillary member positioned in said sleeve.

20. The container of claim 17 further including an air-relief opening arranged above the surface of the pool of ink in said container;

splash deflector means positioned along the interior of said top portion adjacent to said air-relief opening to prevent ink from being emitted from said air-relief opening due to reciprocating movement of said housing while enabling air to freely enter said air-relief opening as the ink is being dispensed.

21. The apparatus of claim 19 wherein the portions of the first and second capillary members which engage one another are substantially parallel to the path of movement of said printing member.

22. The apparatus of claim 21 wherein the portion of the first capillary member which transfers ink to the printing member is aligned substantially perpendicular to the portion of the first capillary member which engages the second capillary member.

23. The apparatus of claim 22 further comprising resilient means for urging said first and second capillary members into engagement with one another.

24. The apparatus of claim 19 wherein said second capillary member is substantially vertically aligned in said container and is enclosed in a non-porous sleeve except for the top and bottom ends thereof to respectively facilitate engagement with said first capillary member and the ink in said container, said sleeve serving to assure uniform flow of ink therethrough.

25. The apparatus of claim 19 wherein said second capillary member has a non-rectangular cross-sectional configuration and is provided with at least one surface portion thereof being substantially flat to facilitate good engagement with said first capillary member.

26. Apparatus for delivering ink to printing means for printing on a print receiving medium, comprising a reciprocating printing member, said ink delivery apparatus comprising:

an ink supply container;

an elongated capillary member having a first end extending into said ink supply container and a second end positioned in the path of movement of the forward end of said printing member, whereby said forward end passes through said capillary member to impact said ink receiving medium, whereby said capillary member delivers ink to the front face at the forward end of said printing member to effect printing by transfer of ink from the printing member to the print receiving medium when the front face impacts the print receiving medium;

a supporting bracket for supporting said capillary member, said supporting bracket having an L-shaped interior surface for supporting said capillary member and positioning said second end in the path of said printing member, said bracket being provided with a narrow opening a spaced distance inward from the front end of said bracket with said capillary member extending through said narrow opening and towards said ink supply container;

spring means having a first end mounted upon said bracket and a second end extending along the first end of said capillary member for supporting the front end of said capillary member.

27. Apparatus for delivering ink to printing means for printing on a print receiving medium, comprising a reciprocating printing member, said ink delivery apparatus comprising:

an ink supply container;

an elongated capillary member having a first end extending into said ink supply container and a second end positioned in the path of movement of the forward end of said printing member, whereby said forward end passes through said capillary member to impact said ink receiving medium, whereby said capillary member delivers ink to the front face at the forward end of said printing member to effect printing by transfer of ink from the printing member to the print receiving medium when the front face impacts the print receiving medium;

a housing for supporting the said printing member; the forward end of said housing having a bearing with an opening; the forward end of said printing member extending through said opening;

a snap-on bracket for supporting said capillary member;

said housing having a pair of flanges;

said snap-on bracket having a pair of recesses for slidably receiving said flanges;

said bracket having also a pair of resilient flanges arranged on opposite sides of said bracket transverse to the front thereof and extending towards one another;

said printing member housing having a pair of projections spaced rearwardly from the front thereof;

said resilient flanges each having a first sloping edge, said first edges substantially forming a V-shape and adapted to separate when engaged by said projections as the housing is inserted into said bracket.

28. The apparatus of claim 27 wherein said resilient flanges each have a second sloping edge, said second edges forming a V-shape and being adapted to urge the front of said housing toward the front end of said bracket when said projections engage said second sloping edges.

* * * * *